US009303936B2

(12) United States Patent
Toner

(10) Patent No.: US 9,303,936 B2
(45) Date of Patent: Apr. 5, 2016

(54) FRAME ASSEMBLY FOR STRIKER-FIRED PISTOL

(71) Applicant: SIG SAUER, INC., Newington, NH (US)

(72) Inventor: Sean Toner, Merrimack, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/594,304

(22) Filed: Jan. 12, 2015

(65) Prior Publication Data

US 2015/0323274 A1 Nov. 12, 2015

Related U.S. Application Data

(60) Provisional application No. 61/926,579, filed on Jan. 13, 2014.

(51) Int. Cl.
*F41A 17/62* (2006.01)

(52) U.S. Cl.
CPC ..... *F41A 17/62* (2013.01)

(58) Field of Classification Search
CPC ..... F41A 17/00; F41A 17/56; F41A 17/62; F41A 17/64; F41A 17/70; F41A 17/74; F41A 17/80
USPC ..... 42/70.01, 70.05, 70.08
See application file for complete search history.

(56) References Cited

U.S. PATENT DOCUMENTS 4,590,697 A * 5/1986 Ruger ..... F41A 17/56 42/70.01
4,726,136 A * 2/1988 Dornaus ..... F41A 9/53 42/7
5,157,209 A * 10/1992 Dunn ..... F41A 17/64 42/70.08
5,251,394 A * 10/1993 Bornancini ..... F41A 17/56 42/70.05
5,267,407 A * 12/1993 Bornancini ..... F41A 17/30 42/70.08
5,303,494 A * 4/1994 Tuma ..... F41A 17/56 42/69.03
5,426,881 A * 6/1995 Ruger ..... F41A 17/74 42/70.08
6,588,136 B2 * 7/2003 Baker ..... F41A 19/48 42/70.02
6,735,897 B1 * 5/2004 Schmitter ..... F41A 17/063 42/70.01
6,880,281 B1 * 4/2005 Orr ..... F41A 17/46 42/69.01
7,213,359 B2 * 5/2007 Beretta ..... F41A 17/72 42/69.03
8,371,058 B2 2/2013 Trpcic
8,572,878 B2 11/2013 Gentilini et al.
2002/0020100 A1 * 2/2002 Roca ..... F41A 9/45 42/70.11
2004/0216347 A1 * 11/2004 Sato ..... F41A 17/32 42/70.01

(Continued)

*Primary Examiner* — Bret Hayes
(74) *Attorney, Agent, or Firm* — Finch & Maloney PLLC

(57) ABSTRACT

A frame assembly for facilitating disassembly of a striker-fired pistol is disclosed. The frame assembly facilitates removal of the slide from a striker-fired pistol without trigger manipulation and with minimized potential for a round to be chambered. The frame assembly includes a takedown safety lever and a takedown actuation lever. Movement of the takedown safety lever causes the sear to be moved such that subsequent slide motion will not result in the storage of striker energy. Movement of the takedown safety lever is only possible while the slide is refracted beyond the point at which a chambered round would be ejected. Removal of the slide does not require pulling the trigger. The positioning of the takedown safety lever motion for disassembly may be precluded by the presence of a magazine in the gun, thereby eliminating the possibility that a round could be chambered during subsequent slide motion.

20 Claims, 7 Drawing Sheets

(56) References Cited

U.S. PATENT DOCUMENTS

2005/0115399 A1* 6/2005 Vaid ..... F41A 17/72 89/196
2006/0162220 A1* 7/2006 Curry ..... F41A 17/72 42/70.08
2008/0163531 A1* 7/2008 Zukowski ..... F41A 17/46 42/21
2011/0162248 A1* 7/2011 Trpcic ..... F41A 17/56 42/108
2012/0174454 A1* 7/2012 Kallio ..... F41A 17/02 42/70.06
2012/0291326 A1* 11/2012 Bova ..... F41A 17/46 42/70.06
2015/0027020 A1* 1/2015 Sheets, Jr. ..... F41A 17/00 42/70.11

* cited by examiner

FRAME ASSEMBLY FOR STRIKER-FIRED PISTOL

RELATED APPLICATIONS

This application claims the benefit under 35 U.S.C. §119 (e) of U.S. Provisional Patent Application Ser. No. 61/926,579, filed Jan. 13, 2014, which is incorporated herein by reference in its entirety.

FIELD OF THE DISCLOSURE

This disclosure relates generally to firearms, and more particularly, to a frame assembly for facilitating disassembly of a striker-fired pistol without triggering.

BACKGROUND

A striker-fired pistol is a type of handgun having a spring-loaded firing pin, which is referred to as a striker. In striker-fired pistols, the striker is the component that strikes the casing of the ammunition to ignite the primer and discharge the projectile. In prior designs, the striker is partially or completely cocked within the pistol as the slide mechanism moves forward as the slide assembly is going into battery, which places tension on the striker spring. As the trigger is pulled, the sear releases the striker, allowing the striker spring to displace the striker forward so that the striker impacts the round. Prior to removing the slide from the pistol for disassembly purposes, the striker must be released from the sear, which is typically accomplished by pulling the trigger. However, this technique has the disadvantage of discharging the pistol should it be loaded, which is potentially dangerous. Further, if a loaded magazine is not removed before disassembly, a cartridge may be loaded into the barrel and subsequently discharged when the trigger is pulled during disassembly.

SUMMARY

According to an example embodiment, a frame assembly for a striker-fired pistol includes a takedown actuation lever and a takedown safety lever operatively coupled to the takedown actuation lever. The takedown safety lever is configured to be moveable with respect to a frame of the pistol between a shooting position and a takedown position responsive to manual movement of the takedown actuation lever. The frame assembly further includes a sear tab extending laterally from the takedown safety lever. The sear tab is configured to engage with a sear of the pistol and, in response to movement of the takedown safety lever, disengage the sear from a striker pin of the pistol. In some cases, the sear tab is movable longitudinally with respect to the frame in response to like movement of the takedown safety lever. In some cases, the sear tab is configured to depress the sear downward with respect to the frame and out of engagement with a striker hook of the pistol while the takedown safety lever is in the takedown position. In some cases, the sear has a cavity or other suitable opening formed in one side thereof, and the sear tab is further configured to engage and slide upon an inclined inner surface of the opening during movement of the takedown safety lever, thereby causing the sear to move downwardly out of engagement with a striker hook of the pistol in response to a downward depression of the sear by the sear tab.

In some cases, the takedown actuation lever is pivotably coupled to the frame of the pistol. In some cases, the frame assembly includes a cam coupled to the takedown actuation lever and configured to rotate about a lateral axis of the pistol in response to like movement of the takedown actuation lever. In some such cases, the takedown safety lever is configured to engage the cam such that rotation of the cam causes the takedown safety lever to move longitudinally with respect to the frame. In some cases, the frame assembly includes a magazine tab coupled to the takedown safety lever and configured to prevent a magazine, by mechanical interference therewith, from being installed into the pistol while the takedown safety lever is in the takedown position. In some cases, the frame assembly includes a takedown safety lever return spring operatively coupled to the takedown safety lever and configured to bias the takedown safety lever forward toward the shooting position.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

As mentioned above, prior to removing the slide from a striker-fired pistol for disassembly purposes, the striker must be released from the sear. This can be accomplished by pulling the trigger. However, this causes the pistol to discharge if it is loaded. Further, if a loaded magazine is not removed before disassembly, a cartridge may be loaded into the barrel and subsequently discharged when the trigger is pulled during disassembly. While disassembly of the pistol is a common procedure, unintended discharges of the pistol can be extremely dangerous for reasons that will be evident.

Thus, and in accordance with a set of embodiments, a frame assembly for facilitating disassembly of a striker-fired pistol without triggering is disclosed. In an embodiment, the frame assembly facilitates removal of the slide from a striker-fired pistol without the need for trigger manipulation and with minimized potential for a round to be chambered. The frame assembly includes a so-called takedown safety lever that may be manipulated using a so-called takedown actuation lever. Movement of the takedown safety lever causes the sear to be moved such that subsequent slide motion will not result in the storage of striker energy. Additionally, movement of the takedown safety lever is only possible while the slide is refracted beyond the point at which a chambered round would be extracted and ejected. Once the takedown lever has been manipulated, no further action (such as pulling the trigger) is needed to remove the slide. In some embodiments, the positioning of the takedown safety lever motion for slide removal is precluded by the presence of a magazine in the gun, thereby eliminating the possibility that a round could be chambered from the magazine during subsequent slide motion. Numerous configurations and variations will be apparent in light of this disclosure.

In some cases, and in accordance with various embodiments, the frame assembly can be configured, for example, as a partially or completely assembled assembly, or a kit or other collection of discrete components as variously described herein that may be used to practice one or more of the disclosed embodiments. Some embodiments can be used, for example, in various types of striker-fired pistols, such as those described herein, or to other types of projectile weapons used by military and law enforcement personnel or by marksmen in general. Other suitable uses and implementations of one or more embodiments of the present disclosure will depend on a given application and will be apparent in light of this disclosure.

Example Structure and Operation

Figure 1:
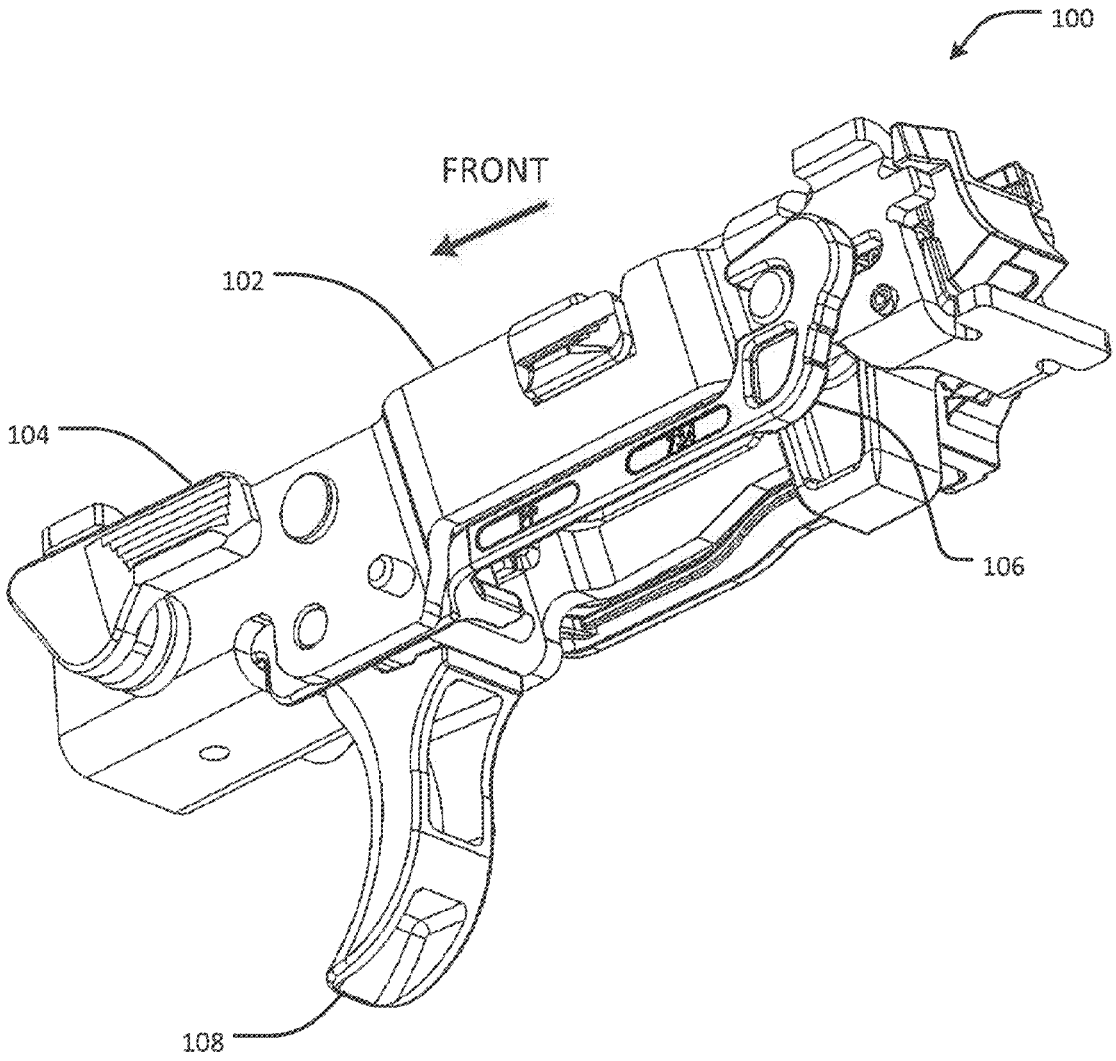
FIG. 1 is a lower left rear perspective view of an example frame assembly for a striker-fired pistol, in accordance with an embodiment of the present disclosure.

FIG. 1 is a lower left rear perspective view of an example frame assembly for disassembling a striker-fired pistol 100, according to an embodiment. The frame assembly 100 may be incorporated within a handgun; however, for illustrative purposes not all components of such a handgun are shown. The frame assembly 100 includes a frame 102, a takedown lever 104 (also referred to herein as a takedown actuation lever) pivotably coupled to the frame 102, a takedown safety lever 106, and a trigger 108. Other components of a handgun in which embodiments variously described herein may be implemented that are not illustrated, such as a body, barrel and slide, will be apparent. The operation and further details of the frame assembly 100 will be described with respect to the following drawings.

Figure 2A:
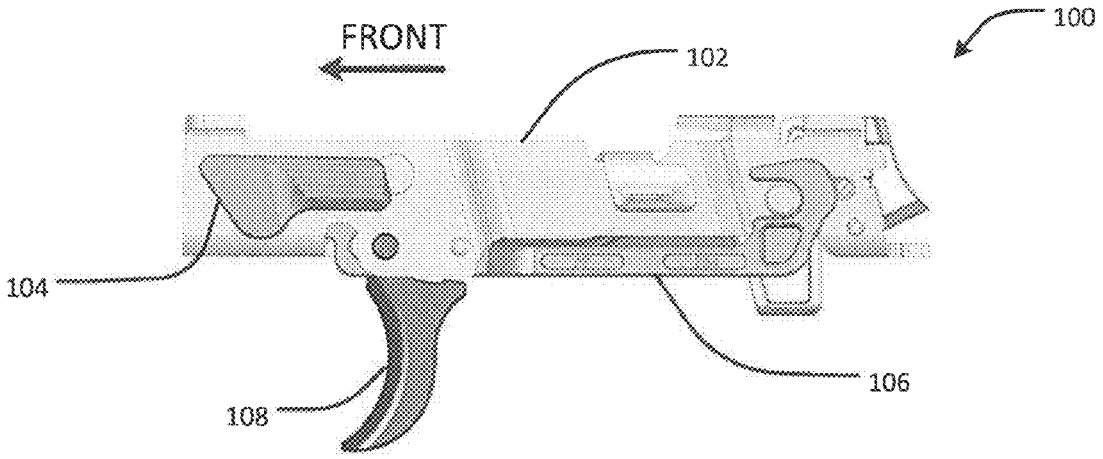
FIG. 2A is a left side view of the example frame assembly of FIG. 1 configured in a first position, in accordance with an embodiment of the present disclosure.
Figure 2B:
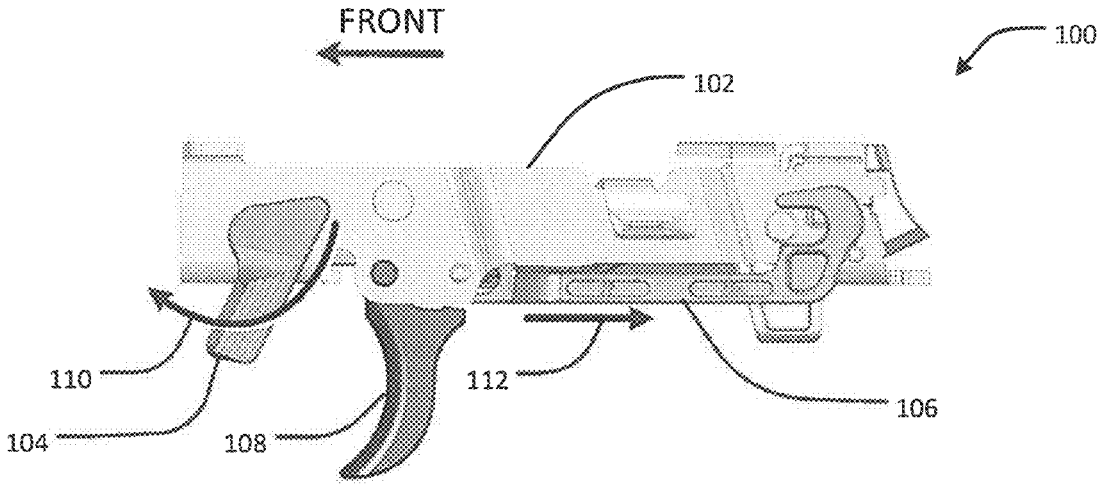
FIG. 2B is another left side view of the example frame assembly of FIG. 1 configured in a second position, in accordance with an embodiment of the present disclosure.

FIG. 2A is a left side view of the example frame assembly 100 of FIG. 1 configured in a first, or shooting, position, and FIG. 2B is another left side view of the example frame assembly 100 configured in a second, or takedown, position, in accordance with an embodiment. In operation, the takedown lever 104 can be rotated clockwise from the shooting position, such as depicted in FIG. 2A, to the takedown position, such as depicted in FIG. 2B and illustrated by arrow 110. When the takedown lever 104 is rotated clockwise from the shooting position to the takedown position, the takedown safety lever 106 moves rearward with respect to the frame 102 as indicated by arrow 112. Likewise, when the takedown lever 104 is rotated counterclockwise from the takedown position to the shooting position, the takedown safety lever 106 moves forward with respect to the frame and in the opposite direction of arrow 112. It will be understood that the direction of rotation of the takedown lever 104 can, in some embodiments, be opposite of that described above.

Figure 3A:
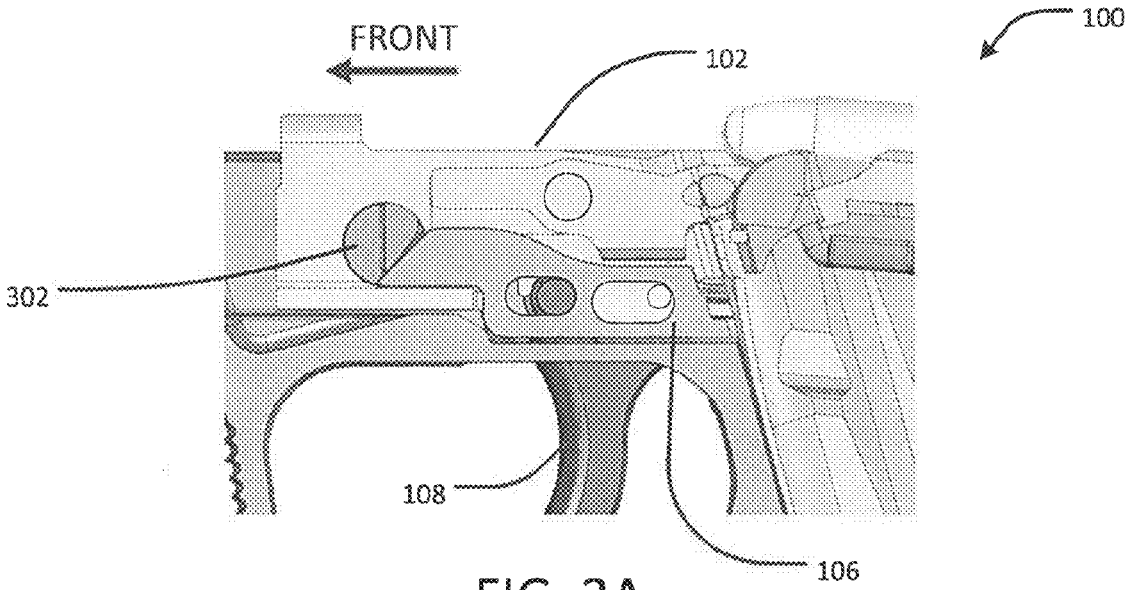
FIG. 3A is a left side elevation view of a portion of the example frame assembly of FIG. 1 shown in the first position, in accordance with an embodiment of the present disclosure.
Figure 3B:
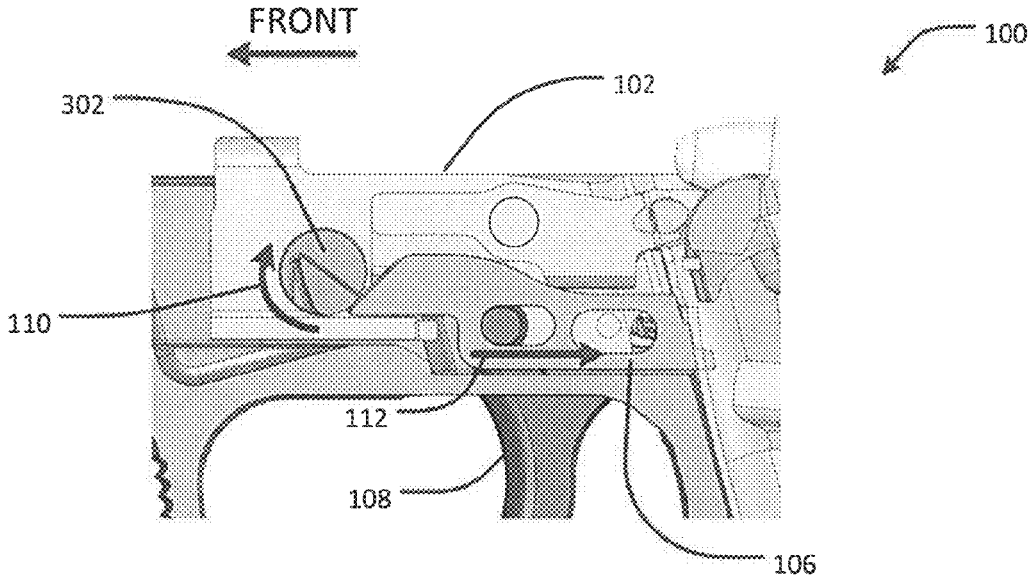
FIG. 3B is another left side elevation view of the portion of the example frame assembly of FIG. 1 shown in the second position, in accordance with an embodiment of the present disclosure.

FIG. 3A is a left side elevation view of a portion of the example frame assembly 100 of FIG. 1 shown in the shooting position, and FIG. 3B is another left side elevation view of the example frame assembly 100 shown in the takedown position, in accordance with an embodiment. For illustrative purposes, the takedown lever 104 is not shown. A cam 302, which may be integral to the takedown lever 104, rotates clockwise when the takedown lever is rotated from the shooting position to the takedown position, as indicated by arrow 110 in FIG. 3B. As the cam 302 rotates clockwise, the cam by its profile urges the takedown safety lever 106 rearward with respect to the frame 102 as indicated by arrow 112. Rotating the cam 302 counterclockwise allows the takedown safety lever 106 to move forward with respect to the frame 102 by action of, for example, a spring (such as shown and described with respect to FIG. 4 below) or other biasing mechanism attached to the takedown safety lever.

Figure 4:
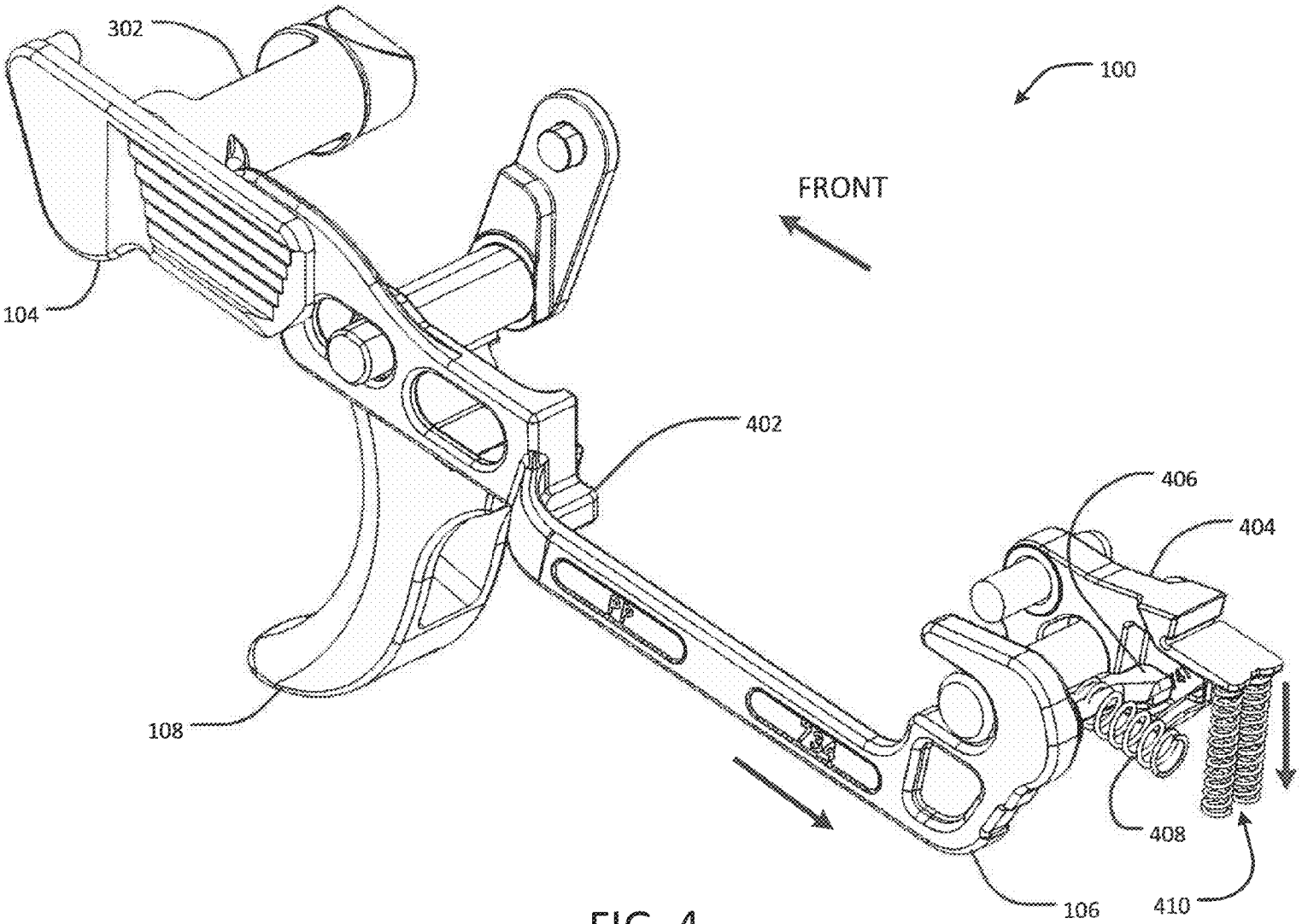
FIG. 4 is an upper left rear perspective view of another portion of the example frame assembly of FIG. 1, in accordance with an embodiment of the present disclosure.

FIG. 4 is an upper left rear perspective view of another portion of the example frame assembly 100 of FIG. 1, in accordance with an embodiment. For illustrative purposes, certain components, such as the frame 102, are not shown. As can be seen in this view, the takedown safety lever 106 includes a magazine tab 402, which is configured to prevent a magazine from being inserted into handgun while the takedown safety lever 106 is in the takedown position by mechanically interfering with complete insertion of the magazine. In some embodiments, the magazine tab 402 may be integral to, or separate from, the takedown safety lever 106, or alternatively eliminated. The magazine tab 402 can, in certain embodiments, prevent rotation of the takedown lever 104 if a magazine is installed in the handgun by mechanically interfering with movement of the takedown safety lever 106 (e.g., by preventing the takedown safety lever from moving rearward). The frame assembly 100 includes a sear 404 which is configured to engage with a firing pin (not shown) of the handgun. The takedown safety lever 106 further includes a sear tab 406 that is configured to move the sear 404 downward while the takedown safety lever 106 is in the takedown position. The sear tab 406 can be integral to the takedown safety lever 106, although it will be understood that in some embodiments the sear tab 406 may be a separate component connected to the takedown safety lever 106. A takedown safety lever return spring 408 is configured to bias the takedown safety lever 106 forward toward the shooting position. A sear spring 410 is configured to bias the sear 404 upward.

Figure 5:
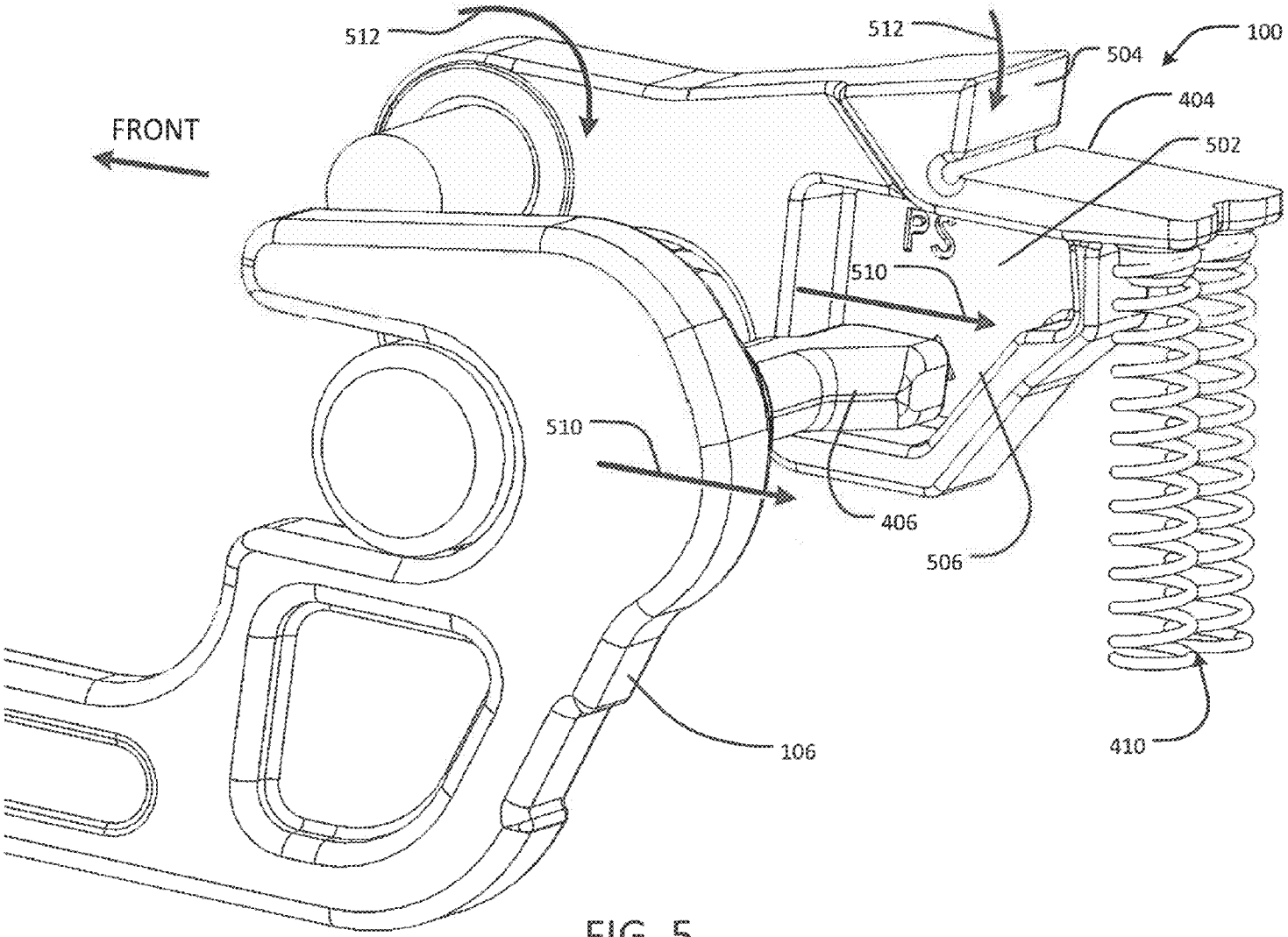
FIG. 5 is a left side perspective view of another portion of the example frame assembly of FIG. 1, in accordance with an embodiment of the present disclosure.
Figure 6B:
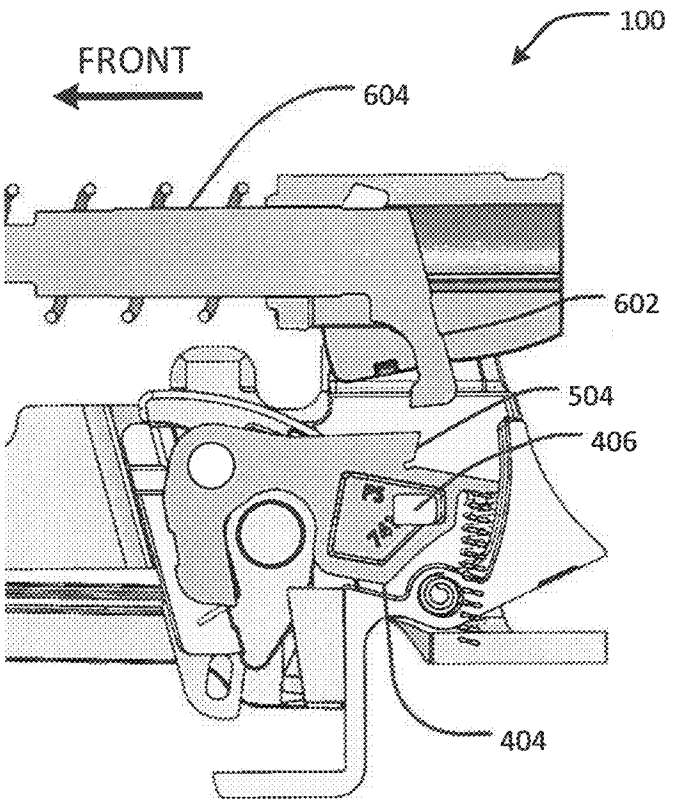
FIG. 6B is another left side elevation view of a portion of the example frame assembly of FIG. 1 configured in the second position, in accordance with an embodiment of the present disclosure.
Figure 6A:
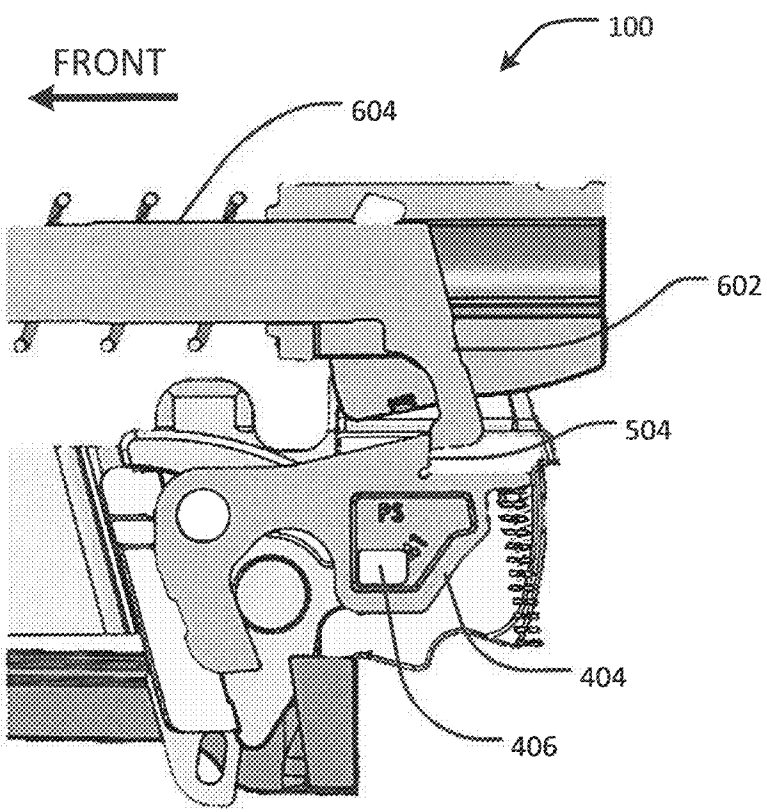
FIG. 6A is a left side elevation view of a portion of the example frame assembly of FIG. 1 configured in the first position, in accordance with an embodiment of the present disclosure.

FIG. 5 is a left side perspective view of another portion of the example frame assembly 100 of FIG. 1, in accordance with an embodiment. FIG. 6A is a left side elevation view of a portion of the example frame assembly of 100 FIG. 1 configured in the shooting position, and FIG. 6B is another left side elevation view of a portion of the example frame assembly 100 configured in the takedown position, in accordance with an embodiment. For illustrative purposes, FIGS. 5, 6A and 6B illustrate the rear portion of the view of the frame assembly 100 with certain components not shown. The sear 404 includes an opening 502 formed in the side of the sear, and a sear hook 504. The opening 502 has an inclined inner surface 506. FIGS. 6A and 6B additionally depict a striker hook 602, which may be operatively connected to a striker 604 or firing pin. The sear hook 504 is movable downwardly out of, and upwardly into, engagement with the striker hook 602, as shown in FIGS. 6A and 6B.

In operation, as the takedown safety lever 106 moves rearward to the takedown position as indicated by arrows 510, the sear tab 406 also moves rearward within the opening 502 such that the sear tab engages and rides along the inclined inner surface 506, which causes the sear to be depressed downwards and in clockwise rotation as indicated by arrows 512. As can be more clearly seen in FIGS. 6A and 6B, as the sear 404 rotates clockwise, the sear hook 504 moves to a position beneath and clear of the plane of the striker hook 602 such that pulling the trigger does not require the striker hook 602 and, accordingly, the firing pin 604 to be moved by trigger action while disassembling the handgun. Likewise, as the takedown safety lever 106 moves forward to the shooting position, the sear tab 406 also moves forward within the opening 502 and along the inclined inner surface 506 of the opening 502, permitting the spring 410 to urge the sear 404 in counterclockwise rotation (e.g., in the opposite direction of the arrows 512) and causing the sear hook 504 to catch the striker hook 602.

Figure 7:
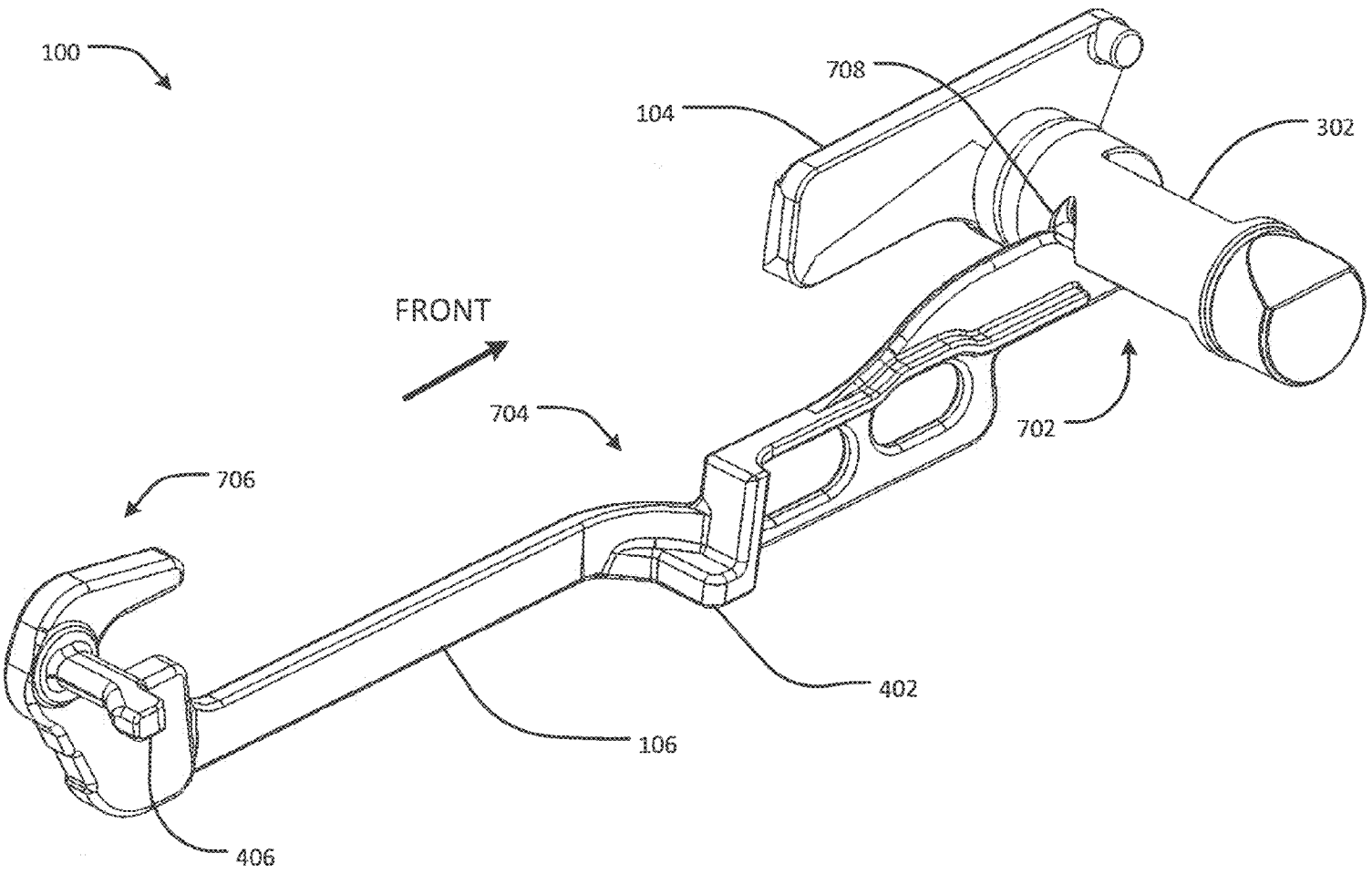
FIG. 7 is a top right rear perspective view of a portion of the example frame assembly of FIG. 1, in accordance with an embodiment of the present disclosure.

FIG. 7 is a top right rear perspective view of a portion of the example frame assembly 100 of FIG. 1, in accordance with an embodiment. For illustrative components, certain components of the frame assembly 100 are not shown. As can be seen in FIG. 7, the takedown safety lever 106 has a front portion (generally indicated at 702), a mid-portion (generally indicated at 704), and a rear portion (generally indicated at 706). The front portion 702 abuts the cam 302. As discussed above, the cam 302 can rotate when the takedown lever 104 is rotated. The cam 302 includes a profiled surface 708 that abuts the front section 702 of the takedown safety lever 106 and, as the cam 302 rotates, causes the takedown safety lever to move rearward or forward, depending on the direction of rotation. The mid-portion 704 of the takedown safety lever 106 may, in some embodiments, include the magazine tab 402, such as previously described. The rear portion 706 of the takedown safety lever 106, in some embodiments, includes the sear tab 406, such as previously described.

Example Use Case

As noted above, disassembly of a striker-fired pistol configured in accordance with an embodiment of the present disclosure can be achieved without actuating the trigger, which beneficially reduces or eliminates the unintended discharge of a round. A handgun configured in accordance with an embodiment of the present disclosure may be used in a manner such as described in the following example takedown procedure with references to FIGS. 1-7. First, the magazine is removed from the firearm. The design of the takedown safety lever 106 is such that the takedown lever 104 cannot be rotated while a magazine is installed in the handgun or while a slide of the handgun is in the forward position. Next, the slide is racked rearward to engage a slide catch lever to lock the slide in the rearward position. Doing so removes any cartridge which may have been inadvertently left in the chamber of the barrel. Next, the takedown lever is rotated from the shooting position to the takedown position until it stops on a grip of the handgun. At this stage, the takedown lever 104 has pushed the takedown safety lever 106 rearward and engaged the sear 404, pushing it down and out of the way of the striker hook 702. While the takedown lever 104 is rotated to the takedown position, the magazine cannot be installed due to interference with the magazine tab 402, making chambering a cartridge from the magazine impossible during disassembly. Next, the slide is held while the slide catch lever is released. At this point, the slide assembly can be removed from the handgun to complete the disassembly procedure.

As will be appreciated in light of this disclosure, the frame assembly may include additional, fewer, and/or different elements or components from those here described, and the present disclosure is not intended to be limited to any particular configurations or arrangements of elements such as those variously described herein, but can be used with numerous configurations in numerous applications. Further, while in some embodiments, the frame assembly can be configured as shown and described with respect to the various figures, the claimed invention is not so limited. Other suitable geometries, arrangements and configurations for various elements and components of the apparatus will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. A frame assembly for a striker-fired pistol, comprising:

a takedown actuation lever;

a takedown safety lever operatively coupled to the takedown actuation lever, the takedown safety lever configured to be moveable with respect to a frame of the pistol between a shooting position and a takedown position responsive to manual movement of the takedown actuation lever; and a sear tab extending laterally from the takedown safety lever, the sear tab configured to engage with a sear of the pistol and, in response to movement of the takedown safety lever, disengage the sear from a striker pin of the pistol.

2. The frame assembly of claim 1, wherein the sear tab is configured to depress the sear downward with respect to the frame and out of engagement with a striker hook of the pistol while the takedown safety lever is in the takedown position.

3. The frame assembly of claim 1, further comprising a cam coupled to the takedown actuation lever and configured to rotate about a lateral axis of the pistol in response to like movement of the takedown actuation lever.

4. The frame assembly of claim 3, wherein the takedown safety lever is configured to engage the cam such that rotation of the cam causes the takedown safety lever to move longitudinally with respect to the frame.

5. The frame assembly of claim 1, further comprising a magazine tab coupled to the takedown safety lever and configured to prevent a magazine, by mechanical interference therewith, from being installed into the pistol while the takedown safety lever is in the takedown position.

6. The frame assembly of claim 1, wherein the sear tab is movable longitudinally with respect to the frame in response to like movement of the takedown safety lever.

7. The frame assembly of claim 1, wherein the sear has an opening formed in one side thereof, and wherein the sear tab is further configured to engage and slide upon an inclined inner surface of the opening during movement of the takedown safety lever, thereby causing the sear to move downwardly out of engagement with a striker hook of the pistol in response to a downward depression of the sear by the sear tab.

8. The frame assembly of claim 1, further comprising a takedown safety lever return spring operatively coupled to the takedown safety lever and configured to bias the takedown safety lever forward toward the shooting position.

9. The apparatus of claim 1, wherein the takedown actuation lever is pivotably coupled to the frame of the pistol.

10. A frame assembly for a striker-fired pistol, comprising:

a takedown actuation lever;

a cam coupled to the takedown actuation lever and configured to rotate about a lateral axis of the pistol in response to like movement of the takedown actuation lever;

a takedown safety lever having a front portion, a mid-portion, a rear portion, the takedown safety lever configured to be moveable with respect to a frame of the pistol between a shooting position and a takedown position, the front portion configured to engage the cam such that rotation of the cam causes the takedown safety lever to move longitudinally with respect to the frame; and a sear tab extending laterally from the rear portion of the takedown safety lever, the sear tab configured to engage with a sear of the pistol and, in response to movement of the takedown safety lever, disengage the sear from a striker pin of the pistol.

11. The frame assembly of claim 10, wherein the sear tab is configured to depress the sear downward with respect to the frame and out of engagement with a striker hook of the pistol while the takedown safety lever is in the takedown position.

12. The frame assembly of claim 10, further comprising a magazine tab coupled to the mid-portion of the takedown safety lever and configured to prevent a magazine, by mechanical interference therewith, from being installed into the pistol while the takedown safety lever is in the takedown position.

13. The frame assembly of claim 10, wherein the sear tab is movable longitudinally with respect to the frame in response to like movement of the takedown safety lever.

14. The frame assembly of claim 10, wherein the sear has an opening formed in one side thereof, and wherein the sear tab is further configured to engage and slide upon an inclined inner surface of the opening during movement of the takedown safety lever, thereby causing the sear to move downwardly out of engagement with a striker hook of the pistol in response to the downward depression of the sear by the sear tab.

15. The frame assembly of claim 10, further comprising a takedown safety lever return spring operatively coupled to the takedown safety lever and configured to bias the takedown safety lever forward toward the shooting position.

16. The apparatus of claim 10, wherein the takedown actuation lever is pivotably coupled to the frame of the pistol.

17. A kit comprising:

a takedown actuation lever;

a takedown safety lever configured to be operatively coupled to the takedown actuation lever and a frame of a pistol, the takedown safety lever configured to be moveable with respect to the frame between a shooting position and a takedown position responsive to manual movement of the takedown actuation lever; and a sear tab configured to attach to and extend laterally from the takedown safety lever and engage with a sear of the pistol and, in response to movement of the takedown safety lever, disengage the sear from a striker pin of the pistol.

18. The kit of claim 17, further comprising a cam configured to be coupled to the takedown actuation lever and to rotate about a lateral axis of the pistol in response to like movement of the takedown actuation lever.

19. The kit of claim 17, further comprising a magazine tab configured to be coupled to the takedown safety lever and to prevent a magazine, by mechanical interference therewith, from being installed into the pistol while the takedown safety lever is in the takedown position.

20. The kit of claim 17, wherein the sear has an opening formed in one side thereof, and wherein the sear tab is further configured to engage and slide upon an inclined inner surface of the opening during movement of the takedown safety lever, thereby causing the sear to move downwardly out of engagement with a striker hook of the pistol in response to the downward depression of the sear by the sear tab.

* * * * *